United States Patent [19]

Pastore

[11] 4,234,101

[45] Nov. 18, 1980

[54] CUP DISPENSER EMPLOYING UNIVERSAL ADJUSTMENT APPARATUS

[75] Inventor: Ronald Pastore, Bedford, N.Y.

[73] Assignee: Cal Pak Industries, Inc., Stanford, Conn.

[21] Appl. No.: 57,351

[22] Filed: Jul. 13, 1979

[51] Int. Cl.[3] ..... A47F 1/06

[52] U.S. Cl. ..... 221/241; 221/267; 221/279; 221/304; 221/310

[58] Field of Search ..... 221/304, 44, 241, 310, 221/4; 312/43, 71

[56] References Cited

U.S. PATENT DOCUMENTS

| | | | |
|---|---|---|---|
| 2,315,827 | 4/1943 | Tansley | 221/304 |
| 2,729,528 | 1/1956 | Bennett | 312/43 X |
| 3,163,323 | 12/1964 | Behrens et al. | 221/304 X |
| 3,581,934 | 6/1971 | Sciascia | 221/304 |
| 3,790,023 | 2/1974 | Filipowicz | 221/304 |

*Primary Examiner*—Allen N. Knowles
*Attorney, Agent, or Firm*—Arthur L. Plevy

[57] ABSTRACT

There is disclosed a cup dispenser which employs a cam actuated cup accommodating and release assembly. A cam ring employs four cam surfaces about the periphery thereof. Each cam surface is associated with a flexible rocker arm. The cam ring is rotatably mounted within a dispenser housing and upon rotation of the ring by means of an associated lever, the rocker arms are moved inwardly or outwardly according to the diameter and dimensions of a cup to be accommodated. The position of the cam ring in regard to the rocker arm is predetermined according to fixed graduations associated with the lever mechanism. The rocker arms have a unique surface configuration which coacts with the cups to enable the top most cup to be withdrawn, while simultaneously exerting a counter force on succeeding cups within the stack. The force is in a direction to retain these cups within the housing, thus facilitating the removal of one cup at a time. Other features of the invention depict apparatus which enables a dispenser to be easily and conveniently mounted in a recessed position in order to provide simple maintenance and access to the adjustable dispensing mechanism.

9 Claims, 6 Drawing Figures

CUP DISPENSER EMPLOYING UNIVERSAL ADJUSTMENT APPARATUS

BACKGROUND OF INVENTION

This invention relates to a cup dispenser and more particularly to a dispensing mechanism for dispensing cups or similar articles employing a universal adjustment means.

There exists a great number of dispensers in the prior art which purportedly function to accommodate a great variety of cups. For example, drinking cups are available in hot or cold paper, foam or plastic. Present cups can vary in regard to their dimensions according to their fluid volume and may vary from six ounces to up to twenty-four ounces. As indicated, these cups can be fabricated from many different materials such as plastic, paper and foam and hence, the characteristics and qualities of the cups vary greatly in regard to strength, rigidity, and resiliency as well as other mechanical considerations.

The prior art is replete with a great number of dispensers which are commercially available and are indicated as universal dispensers. An example of such universal dispensers may be had by referring to a publication of the American Can Company of New York, New York. A manual entitled, "Universal Dispensers", Form A-471 shows such dispensers for accommodating various cup sizes. The dispensers are available as pull type dispensers which are hung on a wall and the cup is withdrawn from the opened bottom end. Other dispensers operate in an inverted position where the cup is pulled up from the top opened end. These dispensers are referred to as inverted dispensers and are basically hung opposite to the pull type. Still other dispensers are referred to as recessed dispensers. These dispensers are adapted for mounting within a cabinet or counter and the cup is pulled out from the top opened end to facilitate use and so on. In a recessed dispenser, additional cups are added through the opened top in order to fill the dispenser as required.

A major problem regarding all such dispensers is the ability for the dispenser to accommodate a great variety of cup sizes and cups fabricated from different materials. The problem is a relatively formidable one in that a paper cup of the same size as a plastic cup can be more easily damaged by a dispenser as it is withdrawn and so on.

Accordingly, such dispensers employ an adjustable jaw mechanism to enable the dispenser to accommodate a number of given cup sizes within a predetermined range. The above described dispensers as distributed by the American Can Company employ a jaw mechanism which consists of an integral bracket arrangement. A slotted steel band is secured about the center portion of the bracket arrangement and is coupled to an adjusting mechanism whereby the diameter of the band can be varied according to the cup size by means of a screw driver adjustment which allows the user to vary the diameter of the band to accommodate the cup size. This adjustment is made by placing a number of cups into the dispenser and then by adjusting the mechanisms until a proper removal or dispensing action is afforded. A suitable example of such a mechanism is shown in the above described brochure and referred to in FIG. 1 and FIG. 2 under the paragraph entitled "How to Adjust your Dixie Adjustable Dispenser".

The adjustment mechanism as briefly described above is compeltely contingent upon the mechanical ability of the user. It is further noted that the mechanism described can provide adjustment in discrete predetermined steps strictly dependent upon the spacing of the slots in the metal band associated with the jaws. It is also indicated that the device requires different adjustment for the same size cup fabricated from different materials. The type of adjustment is also completely discretionary in regard to the user as one can vary the amount of force necessary to withdraw a cup by a slight variation or adjustment of the screw and hence, in this manner, the tension on the cup can be varied from a light pull action to a relatively heavy pull action. A particular problem regarding such dispensers is that one, depending upon the adjustments and so on, can withdraw more than one cup with a single pull. This, of course, is not a serious problem but is a problem which results in the unnecessary use and dispensing of additional cups when only one is desired.

Further problems which exist in the prior art devices involve access to the adjusting means in the case of recessed dispensers which make them relatively difficult to adjust and maintain.

The present apparatus describes a new and improved dispensing mechanism which is capable of infinite adjustability while providing a mechanism which can be preset according to predetermined graduations existing on a scale associated with the mechanism. This therefore eliminates the trial and error approach of adjusting jaws as above described.

A further feature of the present invention enables one to implement a recessed dispenser wherein adjustment and operation of the same is simple and economical as compared to those depicted by the prior art. The universal adjustment apparatus according to this invention enables reliable operation with cups of varying diameters and fabricated from different materials, while providing means operative to decrease the possibility of removing more than one cup at a time and hence, reducing the waste associated with certain prior art dispensers which may not be properly adjusted.

BRIEF DESCRIPTION OF THE PREFERRED EMBODIMENT

A cup dispenser apparatus employing universal adjustment means, comprising a longitudinal tubular housing capable of accommodating a stack of cups to be dispensed, a rotatable cam ring coupled within the hollow of said housing, said ring having a plurality of cam surfaces about the periphery, a plurality of flexible arms having a first end coupled to said housing on said internal wall and a second end coacting with one associated cam surface on one side and for coacting with a cup surface on said opposite side, means coupled to said cam ring for rotating the same and hence, moving said flexible arms into contact with a cup to be dispensed for retaining said cup within said housing and permitting selective withdrawl of the same by a user.

DETAILED DESCRIPTION OF THE FIGURES

Figure 1:
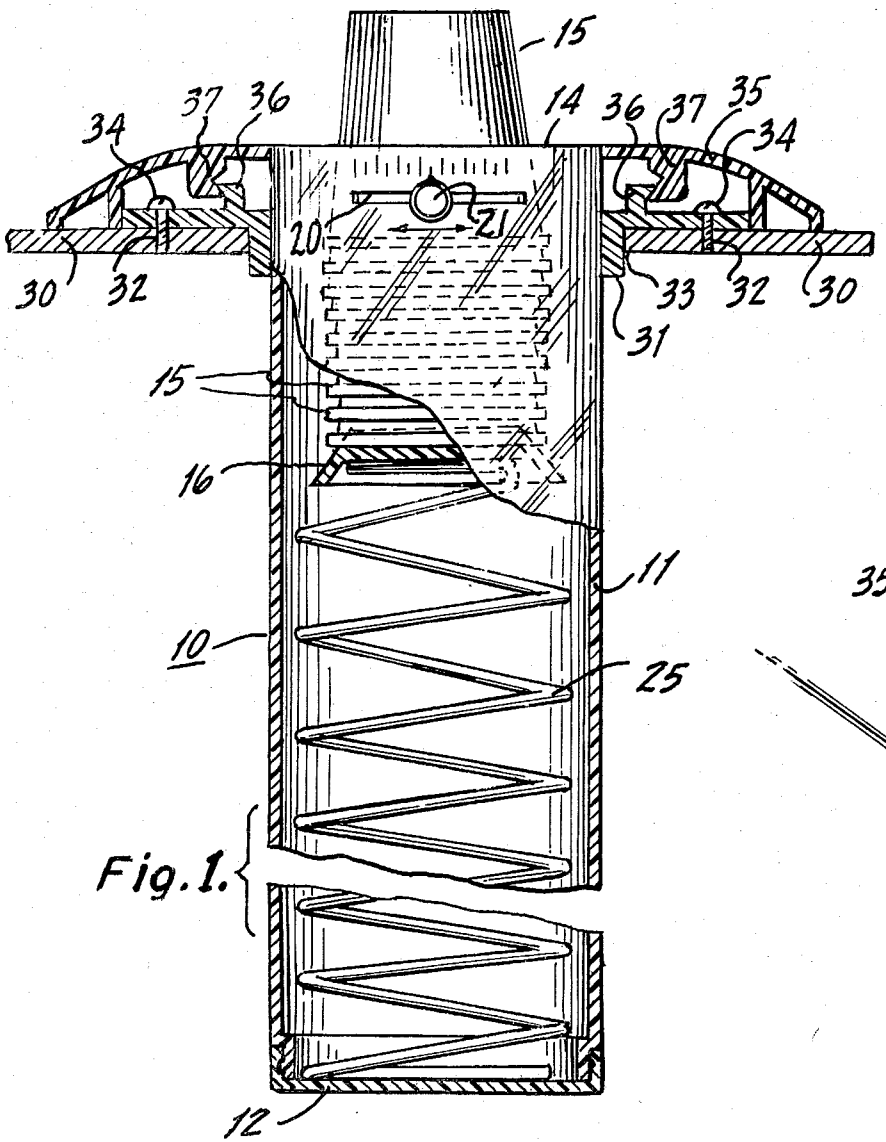
FIG. 1 is a front partial sectional view depicting a recessed dispenser according to this invention.

Referring to FIG. 1, there is shown a cup dispenser 10 according to this invention. The cup dispenser 10 is shown in a recessed position and is adapted for counter mounting. At the onset, it is noted that the universal adjustment mechanism to be described has applicability to all types of dispensers, whether employed in a recessed position as shown in FIG. 1 or the pull or inverted types as briefly described above.

FIG. 1 shows certain features of a dispenser mechanism according to this invention which enables it to provide greater utility than those depicted in the prior art. The dispenser 10 is generally of a cylindrical configuration and comprises a main tubular body 11 which is a longitudinal cylindrical member. As such, the configuration of cup dispensers are well known.

The dispenser 10 may have a bottom lid 12 to gain access to the inside of the dispenser, but in regard to a recessed dispenser, loading of cups occurs from the top of the dispenser.

Essentially, the housing 11 has an aperture 14 at the top which enables one to withdraw a cup as 15 therefrom. Shown in the FIG. is a stack of cups which are urged upwardly by means of a spring 15. The spring 15 is coupled at the bottom end 12 to the housing 11.

Positioned and coupled to the top of the spring is a platform 16 which is trapezoidal in cross-section and of course, circular in the front and back plane so that it is relatively congruent to the internal aperture of the housing 11. The platform shown is trapezoidal in order for it to accommodate a wide plurality of cups as 15 of different sizes and configurations. The trapezoidal slope enables all cup sizes to be accommodated and be positioned about the sloping sides to assure proper centering of the same during dispensing.

The stack of cups rests upon the platform 16 and are urged upwardly by the spring 15. As will be explained, a universal adjustment means operates to exert pressure on the cup stack to enable one to withdraw a cup as desired and to prevent the entire assembly of cups from being discharged through the top opening. For the sake of clarity, the adjustment means is not depicted in FIG. 1 but will be explained subsequently.

Associated with the adjustment means is a slot 20 located near the top of the housing 11. Located within the slot 20 is an adjustment lever 21. As will be explained, the lever 21 enables the user to select any cup size by merely positioning the lever beneath a series of graduations or markings which exist above or below the slot 20. These markings are designated in the FIG. by the uniformly spaced lines located above the slot 20 which may be etched, stamped or otherwise applied to the housing. Hence, as will be ascertained, the movement of the lever 21 within the slot 20 corresponds to the selection of any particular cup size which the dispenser 10 is to accommodate. This selection may be made rapidly and economically by the user.

Shwon in FIG. 1 is the top portion of a counter wall or other mounting member for the dispenser and this is designated by reference numeral 30. The dispenser has secured thereto an annular member 31 having a projecting flange which surrounds the periphery of the dispenser 10. The projecting flange has a plurality of apertures as 32 located on the surface to enable one to secure the dispenser 10 to the platform 30 as shown.

Hence, as can be seen from FIG. 1, the member 31 is coupled to the housing 10. A hole 33 is formed in the counter or platform 30 and the entire dispensing housing 10 is inserted into the hole via the top. The flange associated with member 31, of course, retains the dispenser in the position shown. Screws such as 34 are inserted into the apertures as 32 to therefore secure the dispenser to the platform or to the particular surface 30 upon which it is mounted.

A cover plate 35 is shown and is positioned on the platform and is adapted to be relatively selectively coupled to the annular member 31. As seen from FIG. 1, the flange portions of the annular member 31 have upstanding projections 36. These projections may be positioned at ninety degree intervals about the peripheral flange of member 31 and hence, there may be four such projections, or less, if necessary. The cover plate 35 is also an annular member and has corresponding extending projections as 37 which are spaced at the same locations upon the cover member 35 as the projections 36 are spaced upon member 31.

It is noted that the entire dispensing assembly is fabricated from a suitable plastic which is relatively flexible as is common with most plastic products. Accordingly, once the dispenser 10 is secured to the counter 30 as described, the cover member 35 is placed over the opened top of the dispenser and covers the extending flange associated with member 31. The member 35 is then rotated or otherwise moved until the projection 36 snaps into the projection 37. The projections form a lock and hence, secure the cover member to the flange as shown in FIG. 1.

If one desires to remove the dispenser or to perform an adjustment of the same, one merely uses a flat blade to pry off the cover member 35 which will cause the projections 36 to flex to thereby release the cover member. This can be done very simply and quickly. When the cover member is removed, the adjusting lever 21 is exposed and hence, the user merely has to move the lever according to the size of a batch of new cups to be accommodated. There is no screwdriver adjustment necessary, nor is there any particular discretion required by the user as indicated for prior art devices.

Figure 2:
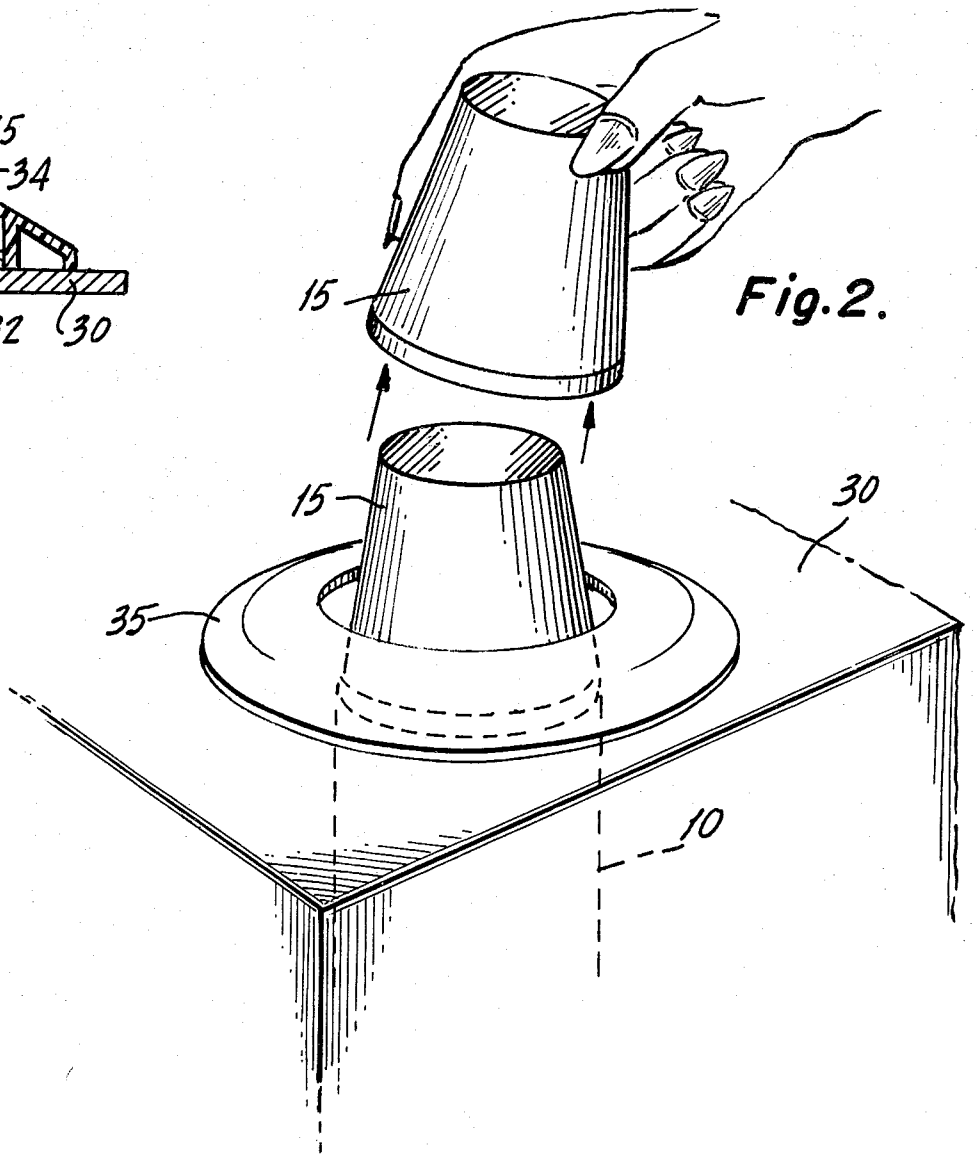
FIG. 2 is a perspective view showing the dispenser of FIG. 1 mounted in a cabinet.

Referring to FIG. 2, there is shown a perspective view generally depicting the appearance afforded by the dispenser 10 when mounted as a recessed dispenser and showing the appearance of the cover member 35.

Thus, as one can ascertain, the above described dispenser enables simple recessed installation by means of the member 31 and the cover member 35. By simply removing the cover member 35, one has immediate access from the top side of the counter or platform 30 to adjust the mechanism and hence, by moving lever 21, one can acheive an immediate change in cup size or type without removing the dispenser from the aperture 33 or without accessing the dispenser housing 11 which is located below the counter or platform 30.

Figure 3:
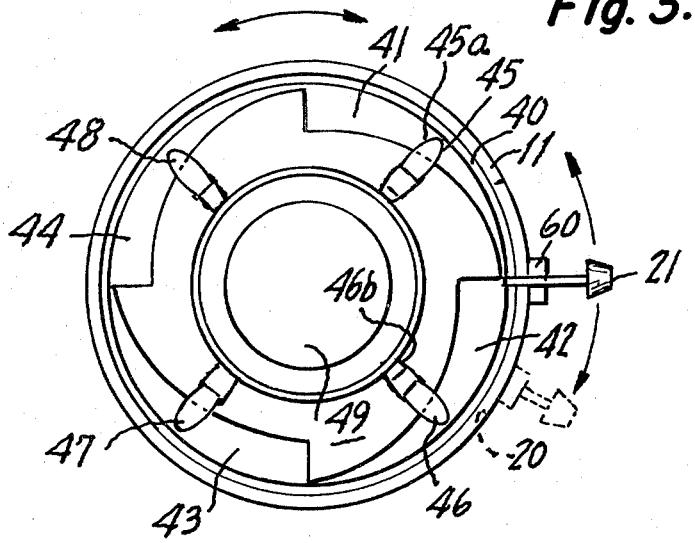
FIG. 3 is a top plan view of a cam ring and rocker arm assembly capable of universal adjustment.
Figure 4:
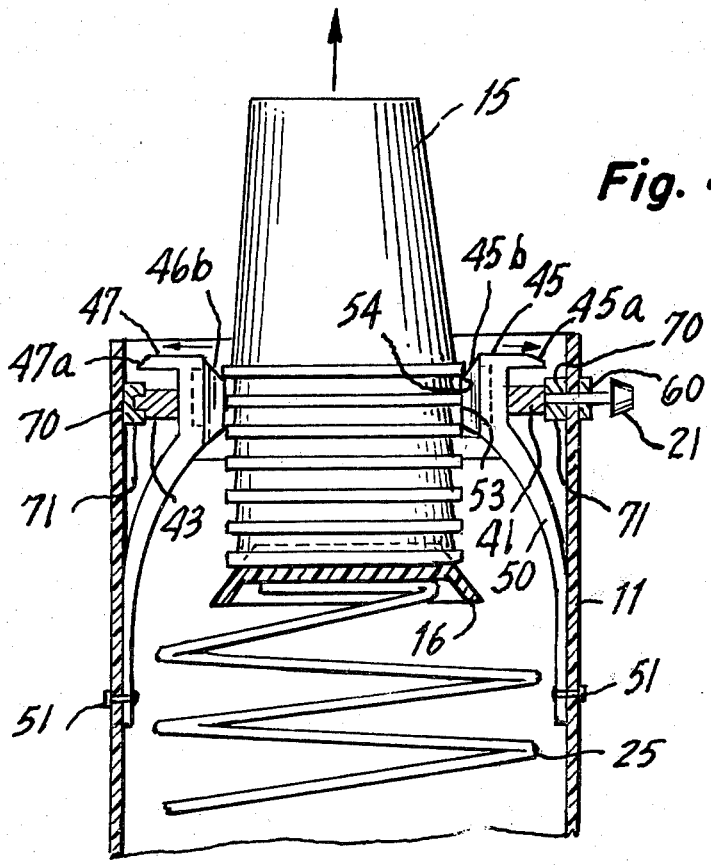
FIG. 4 is a side sectional view depicting the operation of the mechanisms of FIG. 3.

Referring to FIGS. 3 and 4, there is shown a universal adjustment mechanism which may be employed in the dispenser shown in FIG. 1. As indicated, the adjustment mechanism to be described has applicability in regard to any dispenser mechanism where multiple size cups are to be accommodated.

Referring to FIG. 3, there is shown a circular cam configuration 40. Essentially, member 40 is a circular cam ring and has a series of cam surfaces 41 to 44 located on the inner periphery of member 40. Each cam surface is relatively identical in configuration and has a surface configuration which extends through ninety degrees.

Associated with each cam surface as 40 to 44 is a rocker release arm as 45 to 48. The rocker release arms 45 to 48 are spaced ninety degrees apart from each other and four arms are employed to exert a uniform pressure at four points about the periphery of a cup as 49. Hence, cam surface 41 is associated with release arm 45, cam surface 42 is associated with the release arm 46 and so on. The release arms, when viewed in the top plane as in FIG. 3, have an extending top portion as 45A for arm 45 which extends over the respective cam surface towards the outer periphery of the member 40. This extension as 45A for arm 45 is to prevent a user from jamming the mechanism by capturing the release arms within the confines of a cup which is accommodated by the dispenser. Each rocker arm as 45 to 47 has a front surface as 45B which is fabricated from an elastomeric material such as rubber or a soft plastic.

Shown in FIG. 3 is the top view of a cup 49 which is being accommodated by the apparatus described. As can be seen, the cup 49 is grasped by the corresponding surfaces as 45B of each rocker arm.

Referring to FIG. 4, there is shown a partial side view depicting the configuration of two opposing rocker arms as 45 and 47 in order to explain the operation of the invention.

As shown in FIG. 3, the lever arm 21 is rigidly secured to the cam member 40. The cam member 40 in turn is rotatably mounted within the housing 11 near the top thereof. The lever arm is positioned through the slot 20 as in FIG. 1 and may be moved in the directions of the arrows indicated. In this manner, the movement of the lever arm 21 rotates the cam member 40 and hence, moves the rocker arms in and out, depending upon the portion of the cam surface being accessed. Thus, as can be seen, the rocker arms 45 and 46 are pushed inwardly or outwardly depending upon the setting of the lever arm. This therefore enables one to accommodate cups of varying sizes and dimensions.

Referring to FIG. 4, it is seen that the rocker arm basically consists of a vertical body section 50 which is secured to the internal hollow of housing 11 at the bottom end. This may be done by means of glue or a rivet or any suitable fastening device as 51. The rocker arm is fabricated from a flexible plastic material and has a relatively rounded back edge so that it may conveniently coact with the associated cam surface as 41 for arm 45 and 43 for arm 47.

As indicated above, the rocker arm has a front surface such as 45B which is fabricated from an elastomeric material. As such, this material may be inserted within an aperture formed in the rocker arm as shown. The elastomeric material is configured to have a relatively flat central portion 53 for arm 45 and a sloped upper portion 54.

As shown in FIG. 4, the rocker arms 45 and 47 are adjusted by means of the lever 21 to accommodate a cup 49 of a given dimension. Once the lever arm is so adjusted, it may be locked at that position by means of a locking nut or member 60 shown coupled to the lever arm. Many techniques for locking an arm as 20 in position are well known.

As shown in FIG. 4, a top cup 49 is the first in a plurality of stacked cups and hence will be the one that is accessed by a user who desires to withdraw a cup. As cup 49 is pulled upwardly in the direction of the arrow, the rocker arms 45 and 47 are pivoted towards the wall of housing 11 as shown by the arrows. The amount of the pivot or movement is contingent upon the angle which a user is withdrawing the cup at, but generally speaking, the force exerted as the cup is drawn out will tend to move the arms 45 and 47 in the direction of the arrows.

The inclined surface as 54 associated with each projection enables the easy withdrawl of cup 49 but the central portion as 53 exerts a force on the underlying cups in the stack opposite to the direction of the arrows. Due to the fact that the central portion of the resilient surface is not angled, this force tends to keep the corresponding cups within the dispenser and thus aids and enables one to remove only one cup, namely, cup 49 as compared to other cups which are stacked thereto. This action is further magnified if the cup 49 is pulled out or upwardly at a given angle. One can see that the rocker arm as 45 forms a pivot point with the cam surface 41 where they coact and hence, as a cup is withdrawn, the large top head portion of arm 45 tends to pivot about the point of contact.

The slope 54 associated with the top portion of the resilient insert allows one to easily remove cup 49 but any pivoting of the head 45 causes the central portion 53 to firmly firmly grasp the underlying cups and hence prevents one from pulling out more than one cup at a time.

As indicated, the cam member 40 is rotatably mounted within the housing 11 as shown in FIG. 4. This is accommodated by means of a top and bottom retaining ring such as 70 and 71 which form a guide channel to accommodate the outside periphery of the cam member 40 as depicted in FIG. 4. Hence, the cam member may be rotated through ninety degrees to cause the rocker arms to be adjusted to accommodate any desired cup within the above described ranges or practically any cup of any desired diameter depending strictly upon size limitations of the dispenser.

As above indicated, the entire assembly including all above described components with the possible exception of fasteners, such as rivets or screws, may be fabricated from a suitable plastic such as a styrene and so on.

Figure 5:
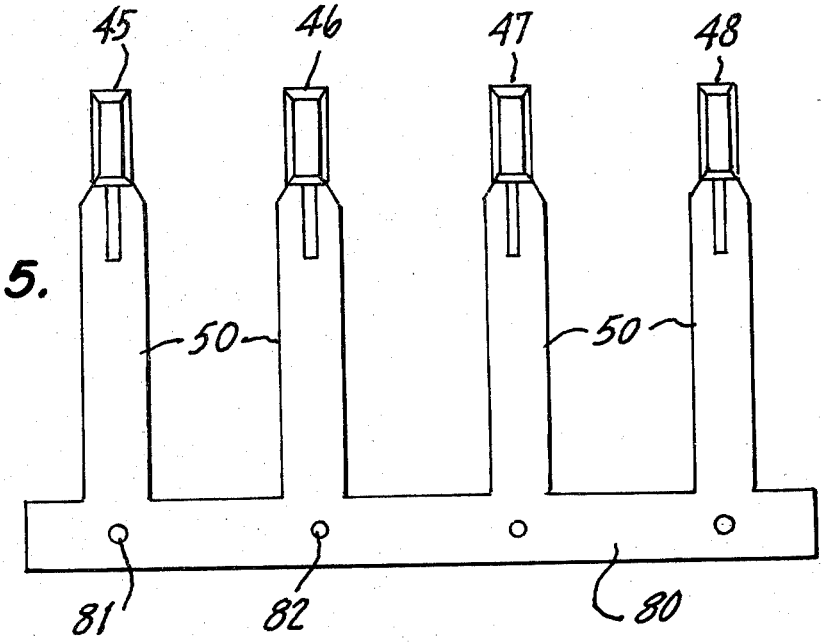
FIG. 5 is a front plan view showing a scheme of construction for a rocker arm assembly.

Referring to FIG. 5, there is shown a front view of a rocker arm configuration fabricated from plastic and having a common integrally formed base as 80. The rocker arms in the front view have been designated by the numerals employed in FIG. 3 for the sake of clarity.

Figure 6:
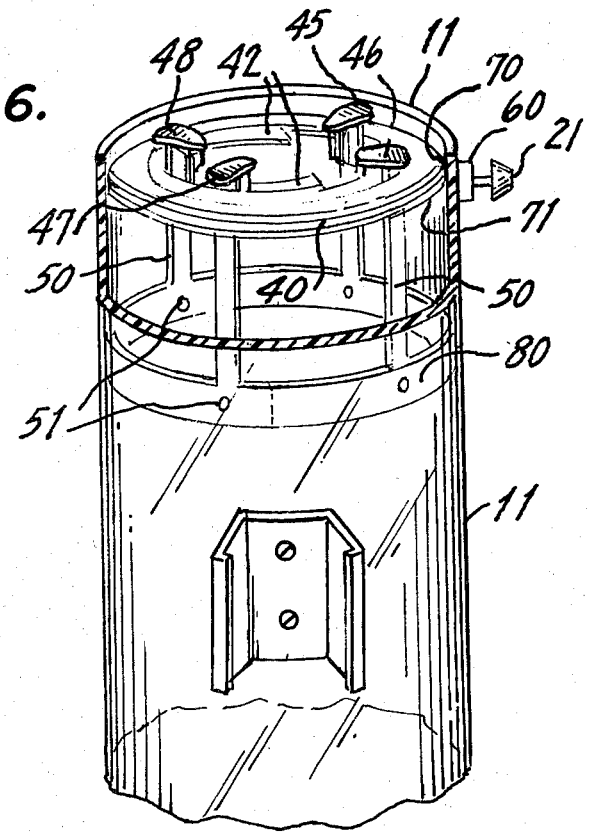
FIG. 6 is a perspective view in partial cross-section showing the assembly of the universal adjustment mechanism.

As can be seen, the arms 45 to 48 may be cut or molded as shown in FIG. 5 with a common base assembly. Since the arms as 50 are relatively thin as is the base assembly 80, the entire mechanism is inserted within the hollow confines of the dispenser 11 near the top end as shown in FIG. 6 and secured to the walls of the dispenser via suitable apertures as 81 and 82 which coact with rivets or other devices to retain the rocker arms in exact relationship to the rotatable cam assembly 40 also depicted in FIG. 6 and shown rotatably coupled to the housing by means of the retaining rings 70 and 71 which are also fabricated from a plastic material and one or both could be integrally formed with the housing.

Hence, it should be apparent to one skilled in the art that the cam actuated adjustment means in conjunction with the rocker arm assembly enables adjustment of the rocker arms by means of a lever or other element which enables rotation of the cam assembly. In this manner, the lever can be moved with respect to predetermined markings above the slot to enable a user to rapidly and reliably select the cup size desired.

The mechanism shown also increases the reliability of operation by exerting a counterforce on other cups within the stack which are located below the top cup and within the central portion of the resilient means. The exact sloped angle as 54 may vary and angles within one to ten degrees with respect to the vertical will suffice to provide the desired action.

Due to the fact that the entire assembly is fabricated from plastic, it is self lubricating and can be maintained easily and economically.

The dispensing mechanism depicted in FIGS. 3 and 4 can be employed for dispensers of the pull type or for dispensers of the inverted type which are not adapted for recessed mounting as shown in FIG. 1. For example, in a pull type dispenser, the mechanisms shown in FIG. 4 would be employed with the exception that the platform 16 and spring 15 would not be necessary as the pull type dispenser primarily works by gravity as aided by the pull of a user when withdrawing a cup. To accommodate such operations, a bracket 80 shown in FIG. 6 is located at suitable intervals on the outside surface of the housing 11 and the bracket can coact with a wall bracket to support the dispenser as shown in FIG. 6 in the position indicated or in an inverted position.

The cups, of course, can be inserted through the top opened aperture of housing 11 as the flexible arms 45 and 47 will be pushed backwardly when cups are inserted to fill the dispenser. Examples of suitable mounting brackets and wall configurations may be had by reference to U.S. Pat. No. 4,132,380 issued on Jan. 2, 1979 to Ronald Pastore and entitled Clip Mechanism And Wall Retention Device For Cup Dispensing Housing Or Similar Article which is assigned to the Assignee herein. It can thus be seen that the dispenser mechanism described employs a universal adjustment apparatus plus other features which enable it to be efficiently maintained and employed.

In one embodiment, the longitudinal tubular housing 10 was approximately twenty inches in length having an outside diameter of approximately 5.30" with an internal diameter of approximately 5.1". The cam ring 40 as depicted in FIG. 3 had a diameter between the outer most excursions of the cam surfaces of approximately 3.90" with an outer diameter of approximately 5.1". The cam ring was retained within the housing by means of the retaining rings 70 and 71; each of which was approximately 5.1" in diameter and positioned one above and one below the cam ring to thus provide a channel to enable rotation of the ring with respect to the housing.

With the above noted dimensions, the dispenser was capable of accommodating cups from nine ounce to a twenty-four ounce capacity. The dispenser operated with both plastic and paper cups, including those with corrugated surfaces. The cam ring was rotated by means of a lever which extended through a slot in the housing enabling one to rotate the cam ring approximately ninety degrees to thereby acheive maximum adjustability. The housing above the slot contained graduated marks as from one to 10 to thereby enable a user to adjust the lever according to a table supplied with the housing. Hence, for example, by setting the lever at position 5, a sixteen ounce cup may be accommodated as by way of example.

It should be obvious to those skilled in the art that many modifications both to construction and design will be apparent from reading the above specification and in regard to the particular configuration of the cam ring and the rocker release arms. Such modifications are deemed to be within the scope and breadth of the claims appended hereto.

What is claimed is:

1. A cup dispenser apparatus employing universal adjustment means, comprising:

(a) a longitudinal tubular housing capable of accommodating a stack of cups to be dispensed, (b) a rotatable cam ring coupled within the hollow of said housing, said ring having a plurality of cam surfaces about the periphery, (c) a plurality of flexible arms having a first end coupled to said housing on said internal wall and a second end coacting with one associated cam surface on one side and for coacting with a cup surface on said opposite side, each of said arms including a flexible central portion having said first end coupled to said housing and a second end top portion having an aperture, an elastomeric member secured within said aperture and having a first central flat region with a top sloping portion, with said central region of said member adapted to coact with a plurality of said cups in said stack, with said sloped portion responsive to the removal of said first cup to cause said central region to exert a force on stacked cups below said first cup in a direction to tend to retain said cups within said housing, (d) means coupled to said ring for rotating the same and hence, moving said flexible arms into contact with a cup to be dispensed for retaining said cup within said housing and permitting selective withdrawl of the same by a user.

2. The dispenser apparatus according to claim 1 wherein said rotatable cam ring comprises a circular ring having four cam surfaces, each of a similar surface configuration occupying ninety degrees of said periphery.

3. The dispenser apparatus according to claim 2 wherein said plurality of flexible arms comprises four arms, each one associated with one of said cam surfaces.

4. The dispenser apparatus according to claim 1 wherein said means coupled to said cam ring comprises a movable lever coupled to said cam ring and extending through a sidewall of said housing via a slot located on said sidewall, whereby movement of said lever within said slot alters the point at which said cam surface coacts with said arms to thereby vary the spacing between said arms according to the dimensions of a cup to be accommodated.

5. The dispenser apparatus according to claim 1 adapted to be mounted in a recessed position by insertion of the dispenser on a surface via an aperture in said surface, comprising:

(a) a flange member fixedly coupled about the outer periphery of said housing and adapted to be inserted within said aperture with said flange retaining said dispenser on said surface, (b) a cover member removably secured to said flange for surrounding said flange to cover the same when said dispenser is viewed from said surface.

6. The dispenser apparatus according to claim 3 wherein said flexible arms are fabricated from a single piece of plastic and are joined together via a common base assembly.

7. The dispenser apparatus according to claim 1 further comprising a spring biased platform located within said housing and adapted to exert a force upon said stack of cups in a direction to aid removal of the same, said platform having a trapezoidal cross-section for accommodating cups of varying dimensions.

8. The dispenser apparatus according to claim 1 wherein said housing, said cam ring and said flexible arms are fabricated from a plastic.

9. The dispenser apparatus according to claim 1 wherein said top sloping portion is at an angle between one to ten degrees with respect to the main axis of said longitudinal tubular housing.

* * * * *